US006316078B1

(12) United States Patent
Smialek

(10) Patent No.: US 6,316,078 B1
(45) Date of Patent: Nov. 13, 2001

(54) SEGMENTED THERMAL BARRIER COATING

(75) Inventor: James L. Smialek, Strongsville, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/525,372

(22) Filed: Mar. 14, 2000

(51) Int. Cl.[7] ..... B32B 3/00; B05D 3/00

(52) U.S. Cl. ..... 428/141; 428/161; 428/163; 428/164; 428/172; 427/248.1; 427/271; 427/299

(58) Field of Search ..... 428/141, 161, 428/163, 164, 167, 172, 632, 633; 427/248.1, 249, 255.36, 271, 299; 148/537

(56) References Cited

U.S. PATENT DOCUMENTS 5,302,465 4/1994 Miller et al. .
5,350,599 * 9/1994 Rigney ..... 427/255.7
5,419,971 5/1995 Skelly et al. .
5,538,796 7/1996 Schaffer et al. .
5,558,922 9/1996 Gupta et al. .
5,652,044 7/1997 Rickerby .
5,681,616 10/1997 Gupta et al. .
5,683,825 11/1997 Bruce et al. .
5,723,078 3/1998 Nagaraj et al. .
5,792,521 8/1998 Wortman .
5,830,586 11/1998 Gray et al. .
5,840,434 11/1998 Kojima et al. .
5,846,605 12/1998 Rickerby et al. .
5,891,267 4/1999 Schaeffer et al. .
5,900,102 5/1999 Reeves .

* cited by examiner

*Primary Examiner*—Donald J. Loney
(74) *Attorney, Agent, or Firm*—Kent N. Stone

(57) ABSTRACT

An article coated with a thermal barrier coating system, and method for preparation of a coated article. The article has a macro-segmented thermal barrier coating due to the presence of a pattern of three-dimensional features. The features may be a series of raised ribs formed on the substrate surface and being spaced from 0.05 inches to 0.30 apart. The ribs have a width W ranging from 0.005 inches to 0.02 inches, and a height R ranging from 25% to 100% of the thickness of the barrier coating. Alternately, the features may be a similar pattern of grooves formed in the surface of the substrate. Other embodiments provide segmentation by grooves or ribs in the bond coat or alternately grooves formed in the thermal barrier layer.

23 Claims, 9 Drawing Sheets

SEGMENTED THERMAL BARRIER COATING

ORIGIN OF THE INVENTION

The invention described herein was made by an employee of the United States Government and maybe manufactured and used by or for the Government for Government purposes without the payment of any royalties thereon or therefor.

BACKGROUND OF THE INVENTION

1. Field of Invention

This invention pertains to the art of thermal barrier coating systems having enhanced resistance to spallation in components exposed to high temperatures, and more specifically to a segmented thermal barrier coating system resulting from modification of the substrate surface and/or modification of one or more layers of a thermal barrier coating.

2. Description of the Related Art

Thermal barrier coatings (TBC) are known in the art in order to protect components which are subjected to high temperature operations. Generally, the thermal barrier coating system includes a ceramic layer for thermal insulation of the component in combination with an additional layer called a bond coat located between the substrate and the ceramic layer. The bond coat typically serves to increase adherence of the ceramic layer on the metallic substrate and protect the underlying substrate from oxidation.

When the substrate is subjected to repeated heating/cooling cycles, thermally induced stresses and strains are produced and accumulate within the thermal barrier coating system. The most common mechanism of failure of the thermal barrier coating system is the spallation of the coating in local regions of the protected component. A crack is produced in the thermal barrier coating where it propagates until a portion of the coating system flakes or chips away. Such spallation failure may occur in patches or over an entire surface.

A number of techniques have been developed to reduce the tendency toward spallation failure of the thermal barrier coating. For example, U.S. Pat. No. 5,558,922 to Gupta discloses a thermal barrier coating for reducing long range stresses. Grooves are formed in the thermal barrier coating in a grid-like pattern, with a groove width of 0.1–0.5 mm (0.004–0.02 inches) and widely spaced from 10–250 mm (0.4–10 inches). This technique is usually directed for use with thick (750 micron, 0.03 inch) TBCs.

As disclosed in U.S. Pat. No. 5,840,434 to Kojima, a segmented thermal barrier coating is produced by separation between columns of the thermal barrier coating grains. This microstructure is produced by control of a physical vapor deposition (PVD) process. The induced cracks are very fine, from 5–10 microns, and closely spaced, about 100–200 microns.

U.S. Pat. No. 5,652,044 to Rickerby discloses a thermal barrier coating comprising a plurality of alternating layers to produce a plurality of interfaces substantially parallel to the metallic substrate/bond coating interface. The structure in the alternating layers is columnar, similar to the microstructure taught in the Kojima reference.

U.S. Pat. No. 5,419,971 to Skelly discloses a very fine surface texturing by means of a grid pattern of v-shaped grooves produced by laser grooving for the purpose of impeding crack growth at the interface of the thermal bond coat and the substrate. The surface features are only about 0.0005 inches deep by 0.0005 inches wide and spaced about 0.005 inches apart.

Other art relevant to the present invention includes U.S. Pat. No. 5,538,796 to Schaeffer et al. wherein an electron beam physical vapor deposition (EB-PVD) thermal barrier coating deposited on a low sulfur or hydrogen annealed single crystal superalloy is disclosed.

Additionally, U.S. Pat. No. 5,302,465 to Miller et al. describes a technique for depositing a yttria stabilized zirconia thermal barrier coating directly onto an oxidation resistant metal without a bond coat.

Although progress has been made, there still exists a need in the art to reduce spallation failure for components subjected to hostile environments.

SUMMARY OF THE INVENTION

The present invention is directed to a macro-segmented thermal barrier coating system wherein each local segment provides increased resistance to spallation. In addition, the macro-segmentation of the thermal barrier retards crack propagation between segments so that the life of the coated component is increased even after local spallation occurs.

In accordance with the present invention, an article protected by a thermal barrier coating system is provided. The article includes a substrate having a first surface for supporting a thermal barrier coating, a thermal barrier coating including a thermal barrier layer being associated with a thickness T, and means for segmenting the thermal barrier coating. The segmenting means includes a plurality of three dimensional features positioned along an imaginary grid defined in a predetermined relationship to the first surface of the substrate. The imaginary grid defines cells of dimension $D_1 \times D_2$ wherein $D_1$ has a value in the range of 0.05 inches to 0.30 inches, inclusive and $D_2$ has a value in the range of 0.05 inches to 0.30 inches, inclusive.

According to one aspect of the invention, the imaginary grid may be coincident with the first surface of the substrate and the features are raised ribs formed on the first surface. The ribs have an associated rib height, R.

According to another aspect of the invention, the ribs may be continuous.

According to another aspect of the invention, the ribs may be discontinuous.

According to another aspect of the invention, R has a value approximately 25% to 100% of T.

According to another aspect of the invention, the imaginary grid is coincident with the first surface of the substrate and the features are grooves formed in the first surface. The grooves have an associated groove depth, G.

According to another aspect of the invention, G has a value approximately 25% to 100% of T.

According to another aspect of the invention, the thermal barrier coating further includes a bond coat layer intermediate the substrate and the thermal barrier layer and the imaginary grid is coincident with a first surface of the bond coat layer. The features may be raised ribs formed on the first surface of the bond coat layer.

According to another aspect of the invention, the thermal barrier coating further includes a bond coat layer intermediate the substrate and the thermal barrier layer and the imaginary grid is coincident with a first surface of the bond coat layer. The features may be grooves formed in the first surface of the bond coat layer.

According to another aspect of the invention, T has a value from approximately 0.002 inches (0.005 cm) to 0.03 inches (0.075 cm), inclusive.

According to another aspect of the invention, the features are associated with a width W, and $D_1$ has a value at least 10W.

According to another aspect of the invention, a method for preparing a coated article having a segmented thermal barrier coating is provided. The method comprises the steps of furnishing a substrate having a first surface; imposing an imaginary grid defining cells of dimension $D_1 \times D_2$ in a predetermined relationship to the first surface, wherein $D_1$ has a value in the range of 0.05 inches to 0.30 inches, inclusive, and $D_2$ has a value in the range of 0.05 inches to 0.30 inches, inclusive; providing a plurality of three-dimensional features positioned along the imaginary grid; and, applying the thermal barrier coating including a thermal barrier layer to the substrate.

According to another aspect of the invention, the step of providing a plurality of three-dimensional features includes providing raised ribs on the first surface of the substrate, wherein said ribs have a associated rib height R.

According to another aspect of the invention, the step of providing a plurality of three-dimensional features includes providing grooves in the first surface of the substrate, wherein the grooves have a associated groove depth G.

According to another aspect of the invention, the step of applying the thermal barrier coating includes applying a bond coat layer intermediate the substrate and the thermal barrier layer.

According to another aspect of the invention, the step of providing a plurality of three-dimensional features includes providing raised ribs on a first surface of the bond coat layer, wherein the ribs have an associated rib height R.

According to another aspect of the invention, the step of providing a plurality of three-dimensional features includes providing grooves in a first surface of the bond coat layer, wherein the grooves have an associated groove depth G.

One advantage of the present invention is elimination or reduction in the major source of crack initiation, namely the free edge of a coated article.

Another advantage of the present invention is extended component life after initial local spallation by providing impediments to crack growth.

Another advantage of the present invention is that a variety of coating methods may be utilized for protecting a component without detracting from the purposes of the present invention.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

The present invention is directed toward a macro-segmented thermal barrier coating system. The segmentation of the thermal barrier coating is due to the presence of three-dimensional features, either ribs or grooves formed on or in a surface of the substrate, or alternately on or in the bond coat layer. Additionally, the segmentation may be due to grooves formed in the thermal barrier layer.

Figure 1:
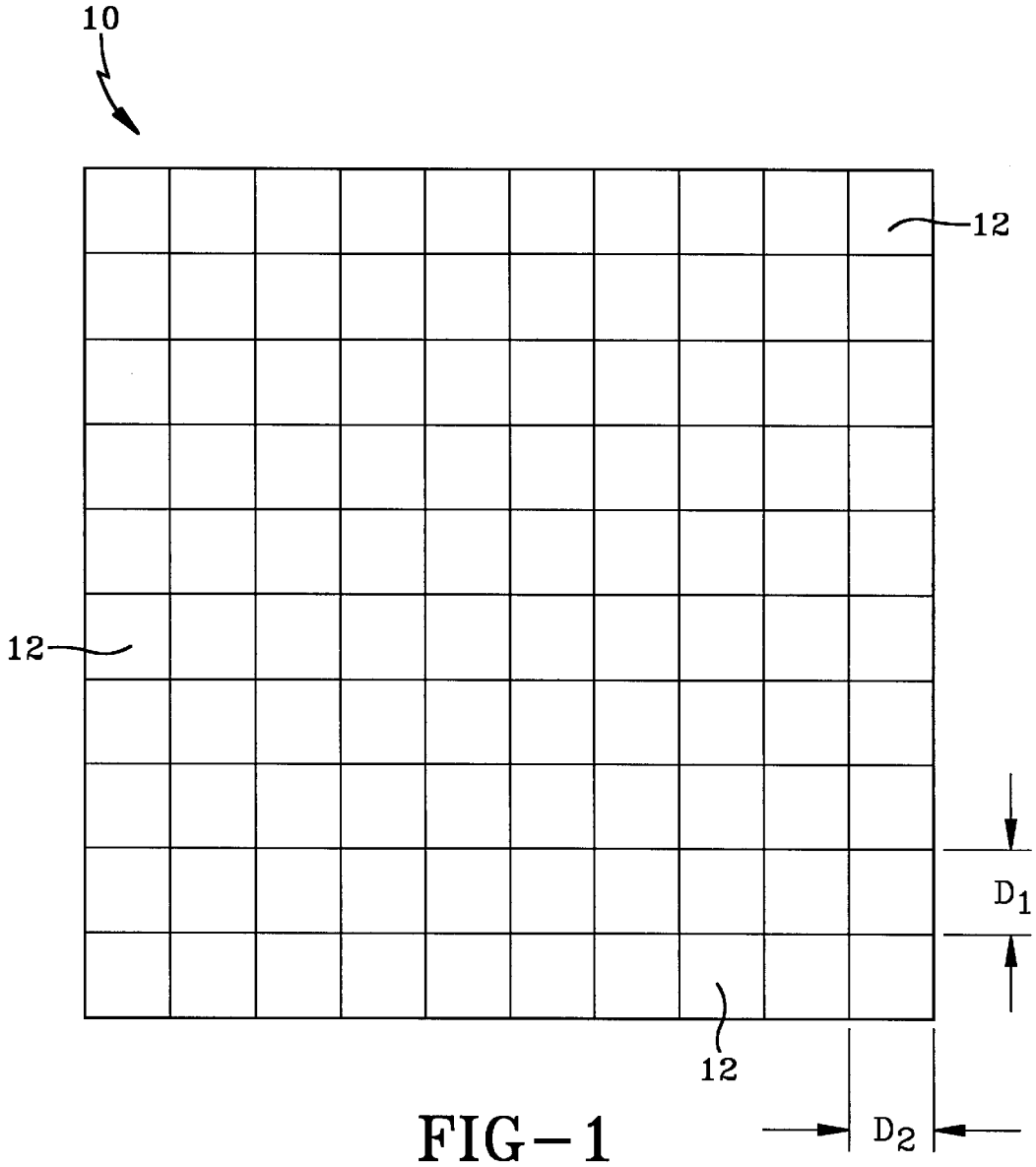
FIG. 1 is a schematic representation of an imaginary grid for determining the position of the three-dimensional features of the invention.

With reference to FIG. 1, the three dimensional features of the present invention are preferably positioned along an imaginary grid 10 having cell dimensions of $D_1 \times D_2$. In a preferred embodiment, the cells 12 are a uniform length and width. In the most preferred embodiment, $D_1$ and $D_2$ are on the order of 0.100 inches. It is within the scope of the present invention to provide $D_1$ and $D_2$ between 0.05 inches and 0.300 inches, inclusive, without a substantive change in the inventive concept. Further, it is within the scope of the present invention to provide a non-uniform segmentation where $D_1$ is not equal to $D_2$, and further more where $D_1$ and/or $D_2$ range from 0.05 inches to 0.300 inches, inclusive.

FIGS. 12–14present schematic representations of various embodiments of the invention showing discontinuous features 13 (ribs or grooves) arranged along an imaginary grid 10. The grid may be coincident with a surface of the substrate or a surface of an optional bond coat layer. In addition, FIG. 14 incorporates the use of "mini-features" 14, positioned within the cells 12 of the imaginary grid 10. The presence of these mini-features 14, ribs or grooves, further segment the thermal barrier coating. The schematic representations of the imaginary grid 10 is provided for clarity only and not by way of limiting the invention. For example, the grid 10 may include curved members without departing from the scope of the invention.

Figure 2:
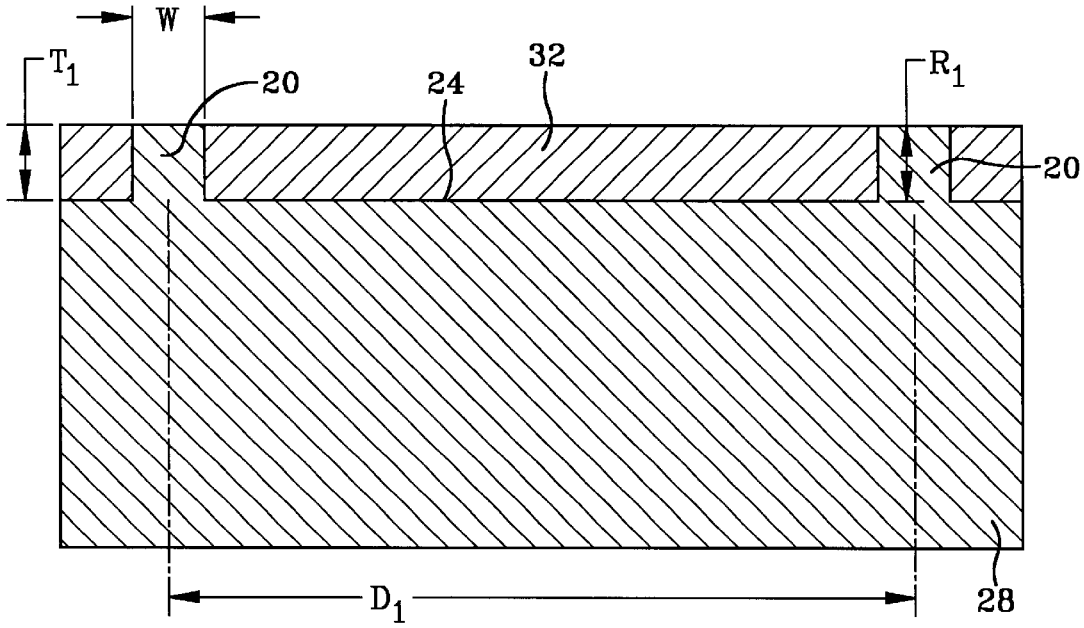
FIG. 2 is a cross-sectional view of a coated article wherein the substrate includes a series of ribs formed on a surface thereof.

One embodiment of the present invention is shown in FIG. 2. In this embodiment, the imaginary grid 10 (not shown) is coincident with the surface 24 of a substrate 28, and therefore follows any contours thereof. The three dimensional features, in this case ribs 20, are formed on the substrate 28 before coating with either a bond coat (not shown in this embodiment), or a thermal barrier layer 32. The ribs 20 may be formed by selectively depositing materials (bond coat, substrate, or other) to produce the ribbed network. Any thermal barrier layer deposits over the ribs 20 may be removed to produce a more aerodynamic surface. Uncoated rib areas may be coincident with arrays of fine (≦0.010 inches, 0.025 cm) cooling holes (not shown) to avoid overheating bare metal regions.

Figure 3:
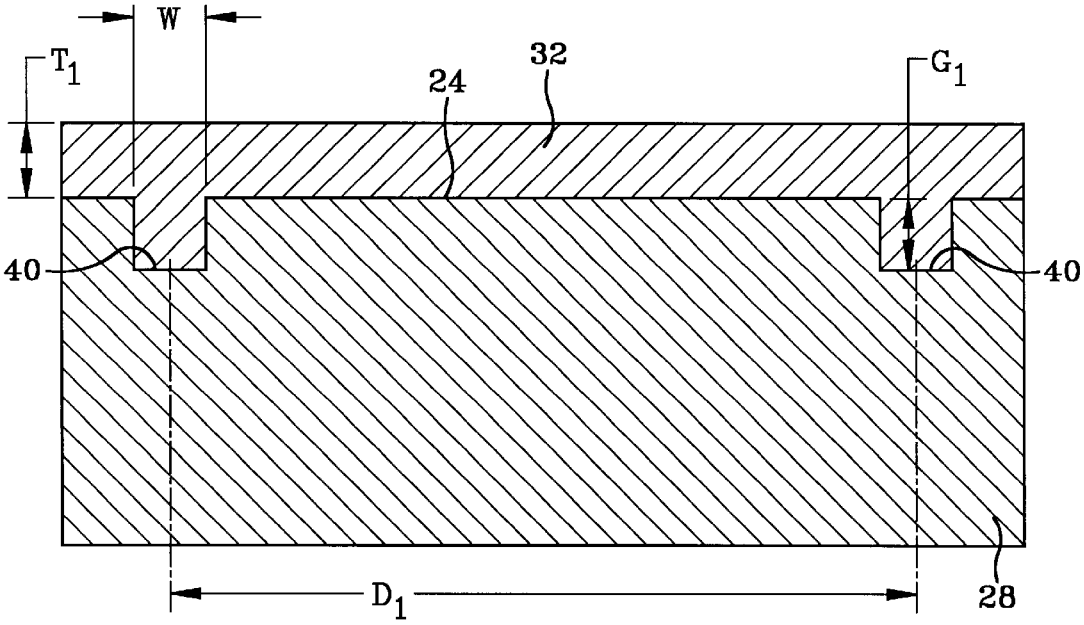
FIG. 3 is a cross-sectional view of a coated article wherein the substrate includes a series of grooves formed in a surface thereof.

In another embodiment of the invention, shown in FIG. 3, the segmentation is provided by a network of grooves 40 in the surface 24 of the substrate 28 before coating with either a bond coat, or a thermal barrier layer 32. The surface topography could be produced in the initial casting or by removing material by conventional electro discharge machining, chemical etching, saw cuts, laser cutting, and the like. As with the embodiment shown in FIG. 2, the imaginary grid is coincident with the surface 24 of the substrate.

Figure 4:
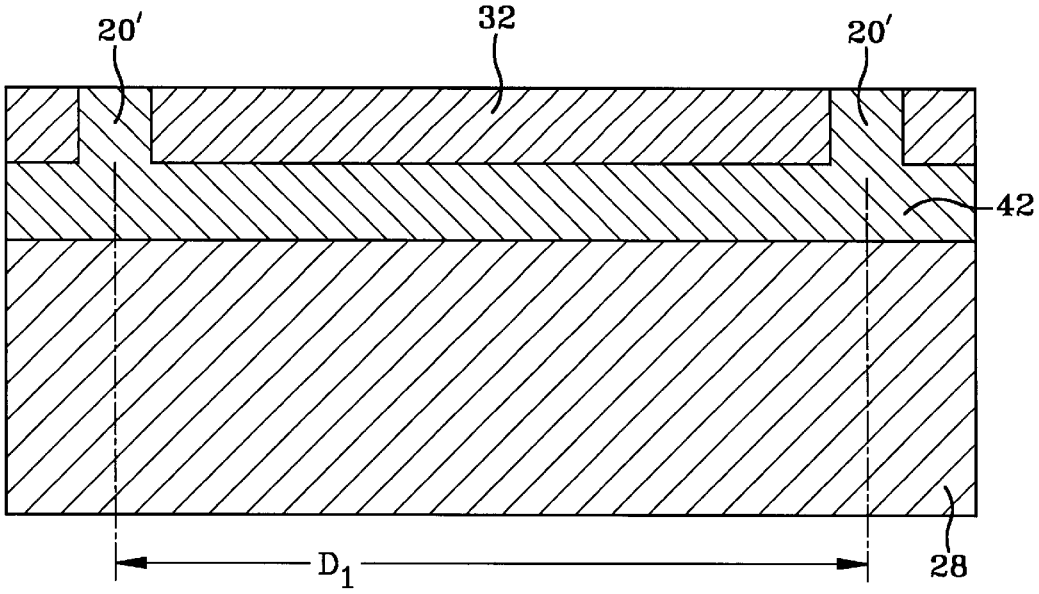
FIG. 4 is a cross-sectional view of a coated article showing a substrate, a ribbed bond coat, and a thermal barrier layer.
Figure 5:
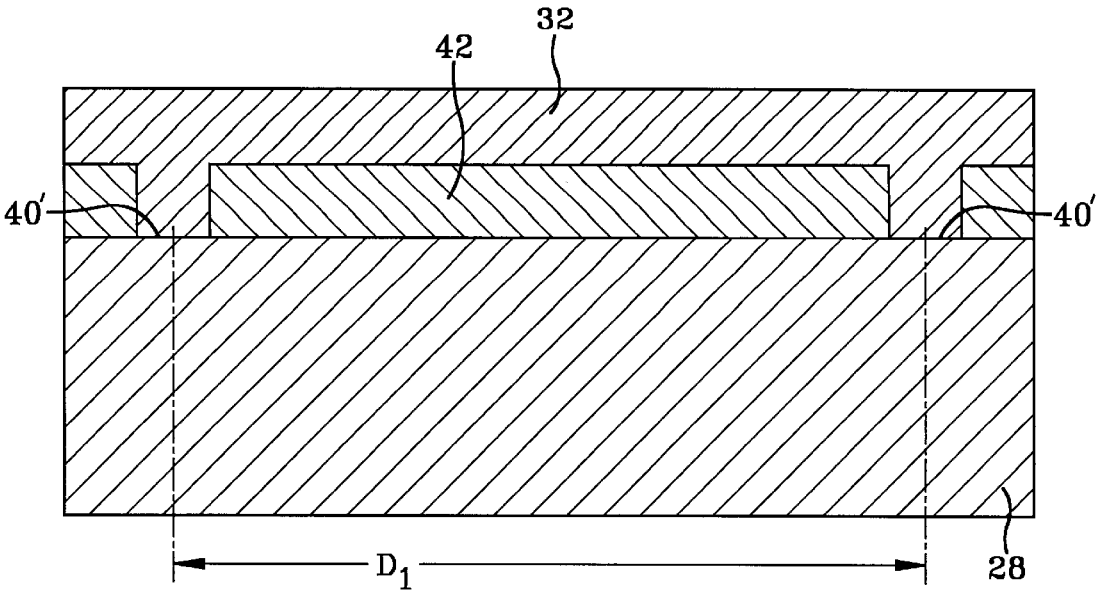
FIG. 5 is a cross-sectional view of a coated article showing a substrate, a grooved bond coat, and a thermal barrier layer.

In another embodiment of the invention, shown in FIG. 4, the segmentation may be provided by a network of ribs 20' on the surface of the bond coat 42 after deposition onto a substrate 28. Additionally, as shown in FIG. 5, the segmentation may comprise a network of grooves 40' formed in the bond coat 42. In these embodiments, the imaginary grid 10 (not shown) can be envisioned as being spaced from the surface 24 of the substrate, but in predetermined relationship thereto. In this example, the imaginary grid 10 (not shown) may be coincident with a surface of the bond coat 42.

Figure 6:
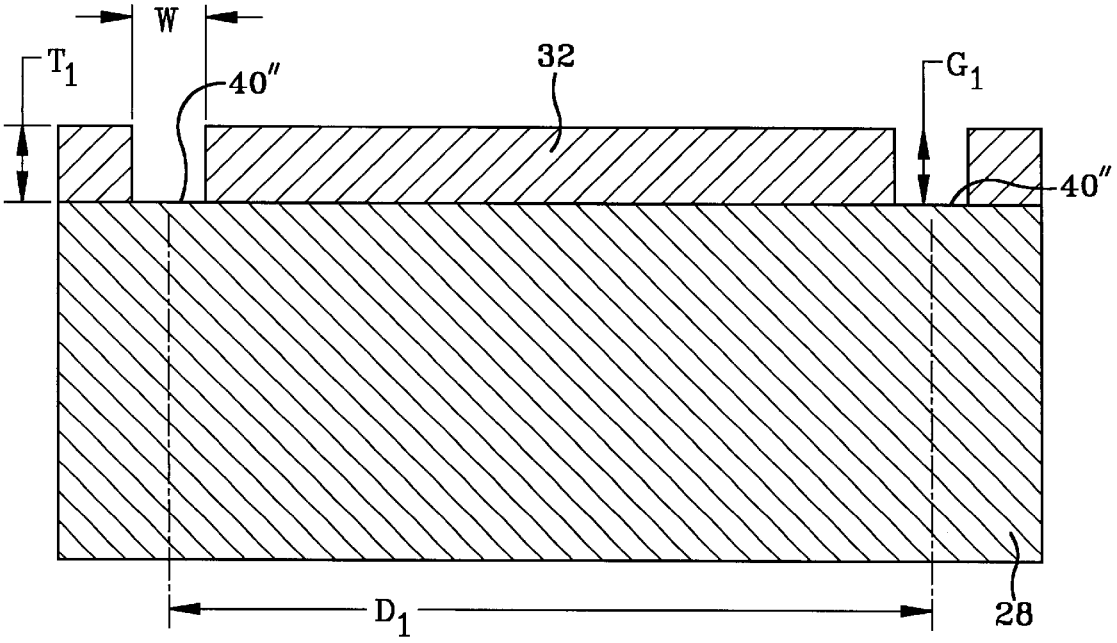
FIG. 6 is a cross-sectional view of a coated article showing a substrate and a segmented thermal barrier layer without a bond coat.

FIG. 6 shows yet another embodiment of the invention wherein the segmentation is provided by grooves 40" in the thermal barrier layer 32 after deposition. The thermal barrier layer 32 may be deposited by conventional plasma spray, electron beam, physical vapor deposition, or alternate techniques. The thermal barrier layer 32 is typically 0.005–0.010 inches in thickness, but could conceivably be thinner, e.g. ~0.002 inches, or thicker, e.g. ~0.030 inches. The embodiment shown in FIG. 6 does not include a bond coat layer 42, but it is within the scope of the present invention to include a segmented thermal barrier layer 32 after deposition onto a bond coat layer 42.

With reference again to FIGS. 2 and 3, the heights of the ribs, $R_1$, or the depth of the grooves, $G_1$, should be a significant fraction of the thickness, $T_1$, of the thermal barrier layer 32, as measured between adjacent three dimensional features. As illustrated in FIG. 2, $T_1$ is measured as the thickness of the thermal barrier layer 32 in the space between adjacent ribs 20. Alternately, $T_1$ is measured as the thickness of the thermal barrier layer 32 in the space between adjacent grooves 40 as shown in FIG. 3. The minimum value for $R_1$ or $G_1$ is preferably on the order of $0.25T_1$ up to a maximum value of approximately $T_1$. For example, for a thermal barrier layer 32 having a thickness of 0.010 inches, the height, $R_1$, of the rib 20 would be from 0.0025–0.010 inches, inclusive. If a grooved network is utilized, the depth, $G_1$, of the groove 40 would range between 0.0025–0.010 inches, inclusive. The width, W, of the rib 20 or groove 40 is preferably in a range of $0.5T_1$–$2T_1$ and more preferably approximates the thickness $T_1$ of the thermal barrier layer 32.

In each of the preferred embodiments, the spacing between adjacent ribs 20 or grooves 40 measured centerline to centerline is shown as dimension $D_1$ In the preferred embodiment, $D_1$ is at least ten times greater than W.

With particular reference to FIGS. 2 and 4, in ribbed embodiments when the rib height $R_1$, is approximately 100% of the thickness $T_1$ of the thermal barrier layer 32, the thermal barrier layer 32 can be envisioned to be physically discontinuous to a large extent, resulting in a thermal barrier coating that is segmented into discreet quadrilaterals. This arrangement acts as a long range stress insulator, providing resilience and compliance to the thermal barrier coating on a macro scale. The embodiment shown in FIG. 6 may incorporate grooves with a groove depth $G_1$ approximately equal to $T_1$. Such an arrangement also provides a physically discontinuous thermal barrier coating.

The thermal bond layer 32 may be constructed with the usual prior bond coating steps, or in the case of oxidation resistant low-sulfur superalloys, it may be deposited directly onto the substrate 28 as shown in FIGS. 2, 3 and 6.

EXAMPLES

Figure 7:
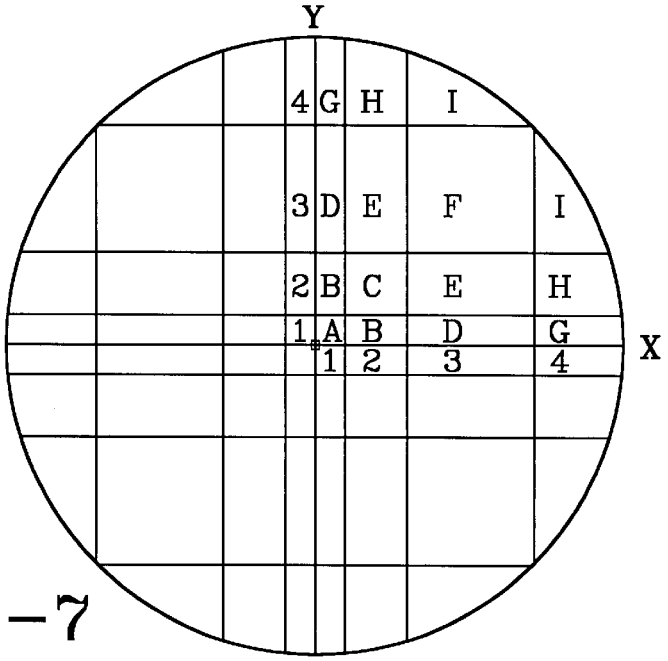
FIG. 7 is a schematic representation of a ribbed or grooved test sample.

A test pattern of grids was electro-discharge machined onto one surface of 0.050" thick×1" diameter disc specimens of low-sulfur PWA 1484, leaving a flat back side. The pattern consisted of squares and rectangles 0.050", 0.100", or 0.200" on a side, creating a total of 60 segments per sample, as shown in FIG. 7. Two duplicate samples were produced with ribs forming the network, where the ribs were about 0.012" high and 0.012" wide. Two other duplicate samples were produced with a similar network formed by grooves. Surfaces were grit blasted to enable adhesion. About 0.010" of 8YSZ TBC was air plasma sprayed onto the surface without bond coats. One of each of the ribbed and grooved samples was further annealed at 2282° F. (1250° C.) for 50 hr. in 5% $H_2$/Ar to remove any sulfur added during processing and to desulfurize beyond the as-cast level. All samples were oxidized in 2012° F. (1100° C.) interrupted furnace oxidation tests, with samples cooled down 28 times and the weights recorded (after 1, 5, 10, 20, 40, . . . 2000 hr).

Figure 8:
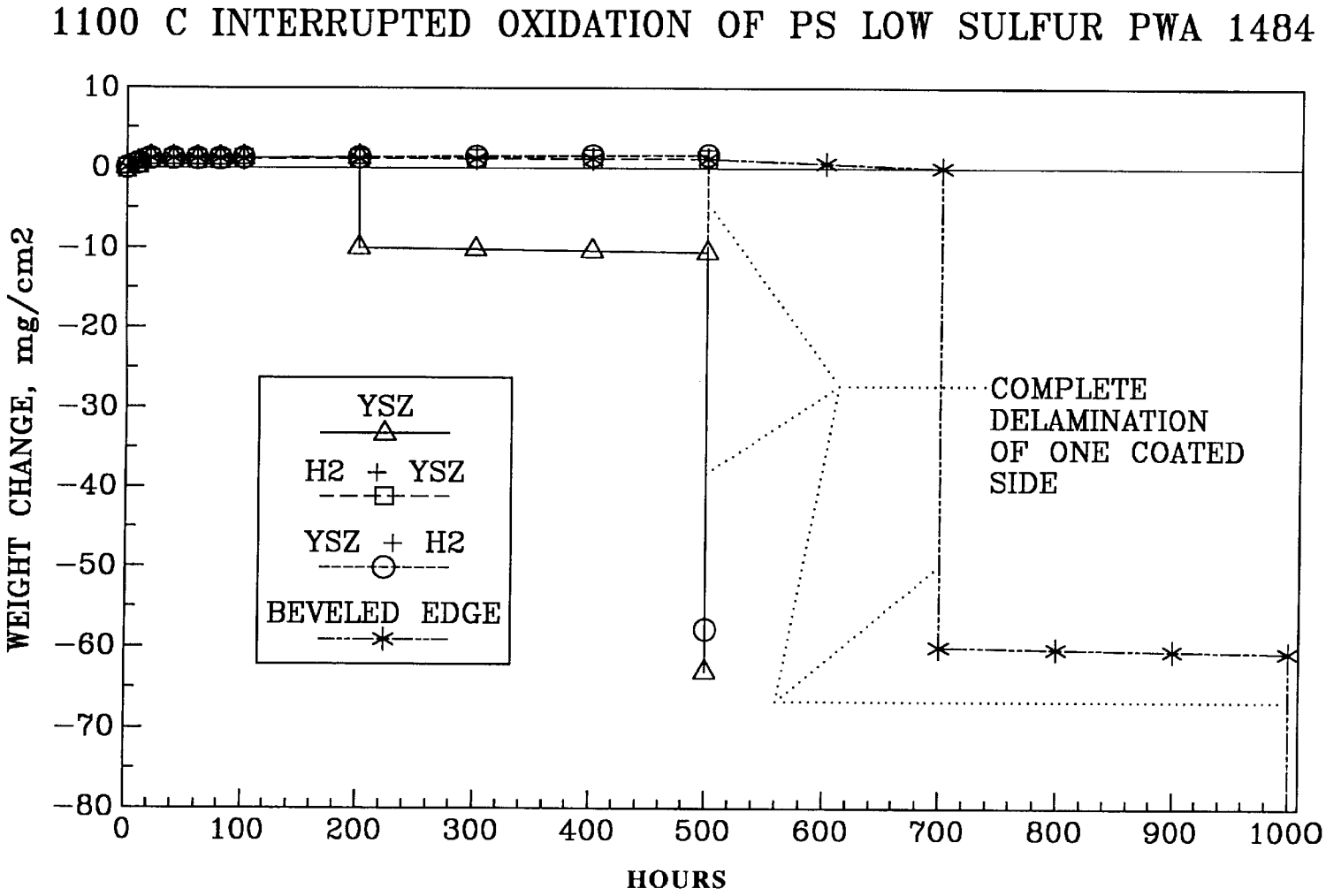
FIG. 8 is a graphical representation of weight change against time for 1100° C. interrupted oxidation of PS Low Sulfur PWA 1484 flat disc samples.

FIG. 8 is directed to the Interrupted Oxidation of the control samples having no rib or groove network.

Figure 9:
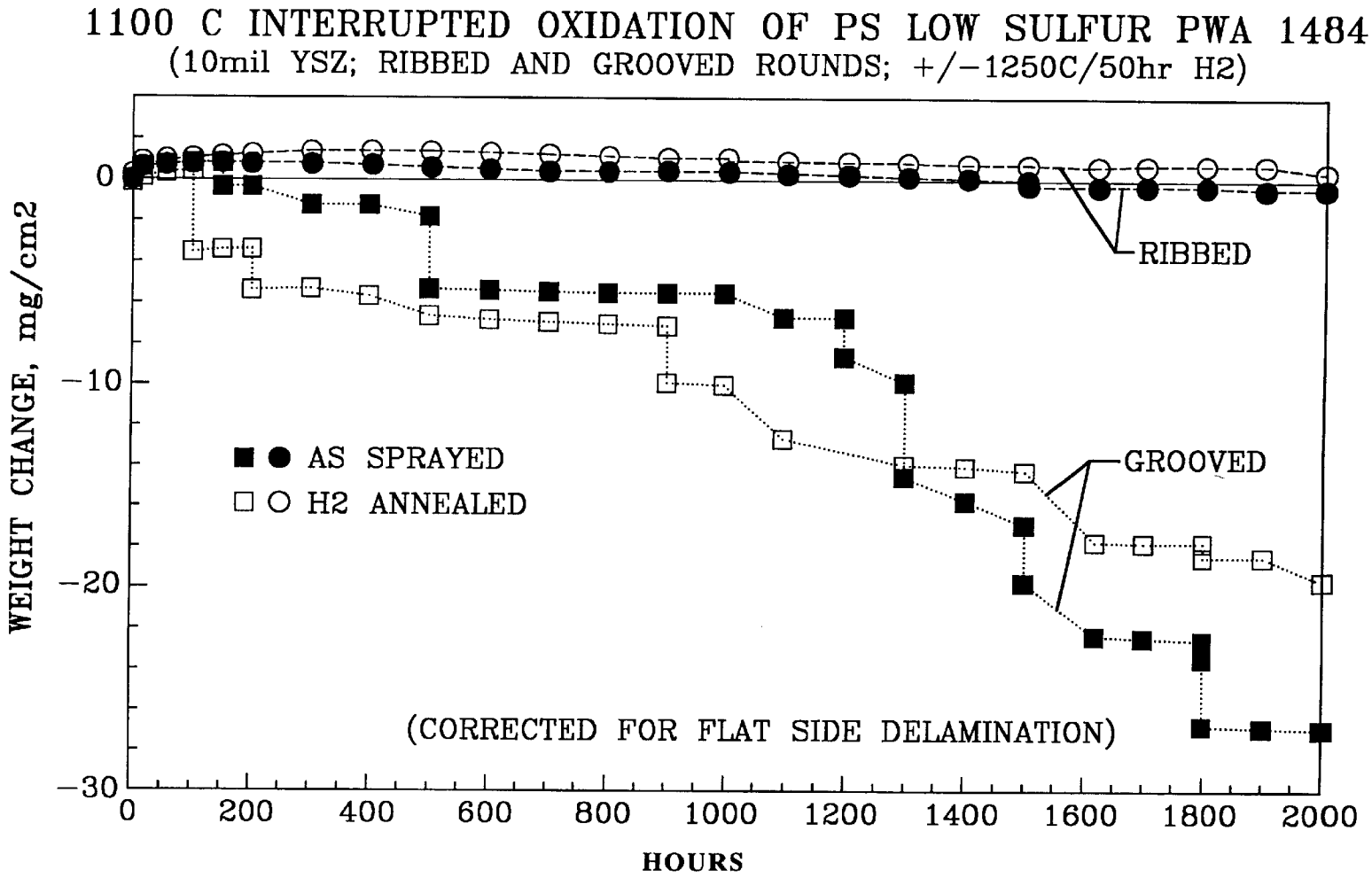
FIG. 9 is a graphical representation of weight change against time for 1100° C. interrupted oxidation of PS Low Sulfur PWA 1484 ribbed or grooved disc samples (weights corrected for spalling of the coating from the flat obverse side)
Figure 10:
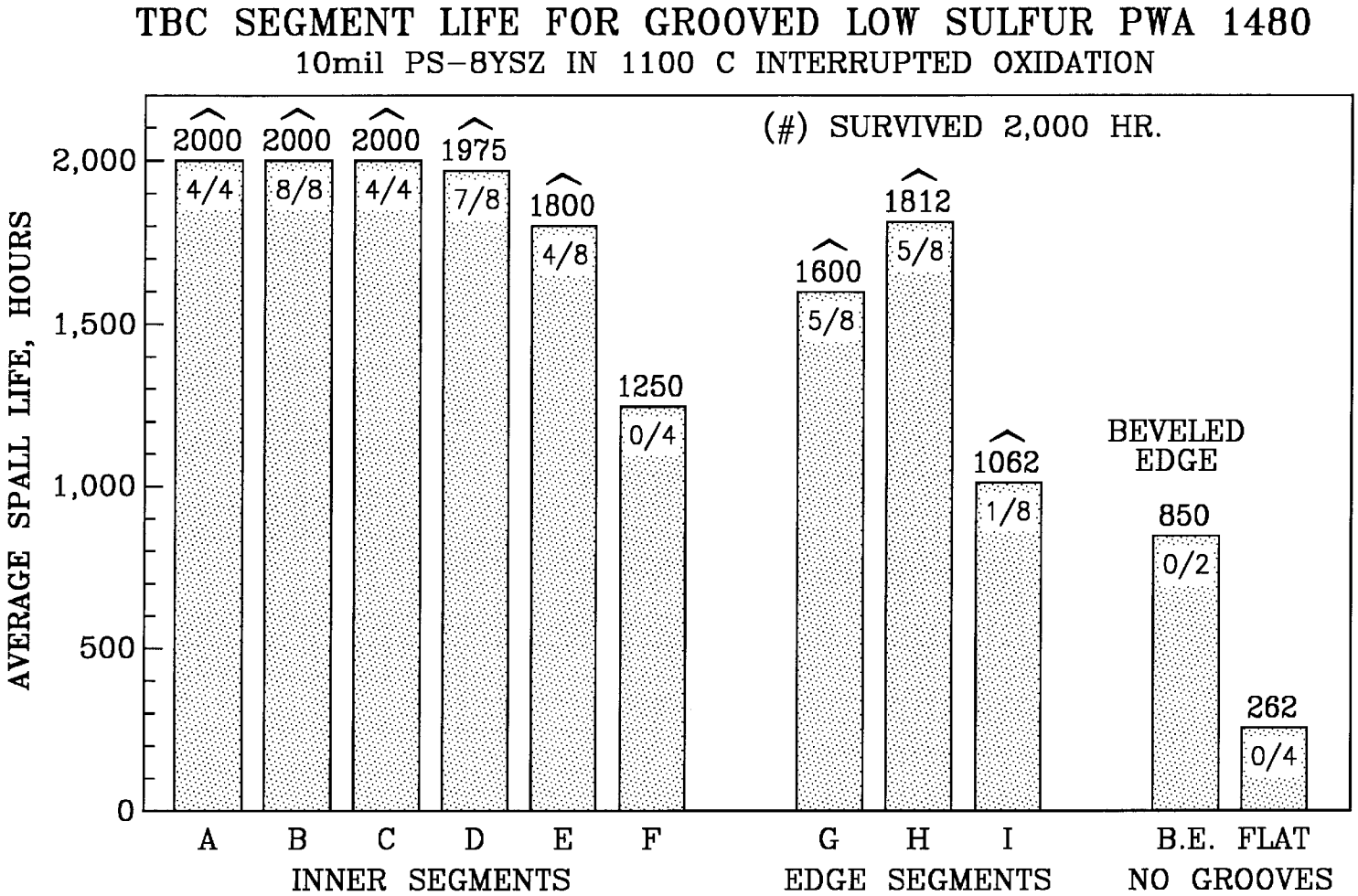
FIG. 10 is a graphical representation of average spall life against segment size and position, as coated samples; and, FIG. 11 is a graphical representation of average spall life against segment size and position, hydrogen annealed samples.
Figure 11:
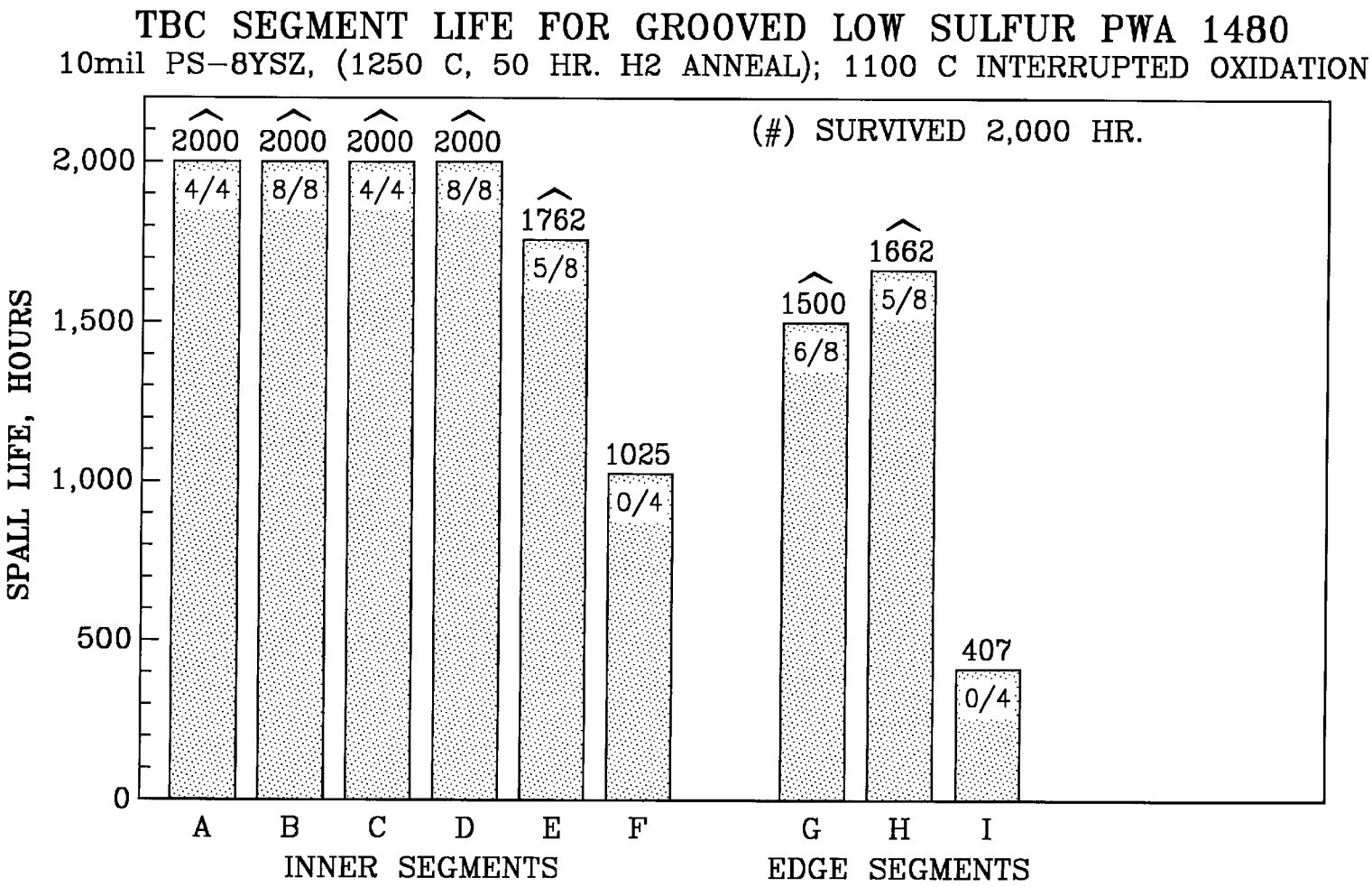
Figure 12:
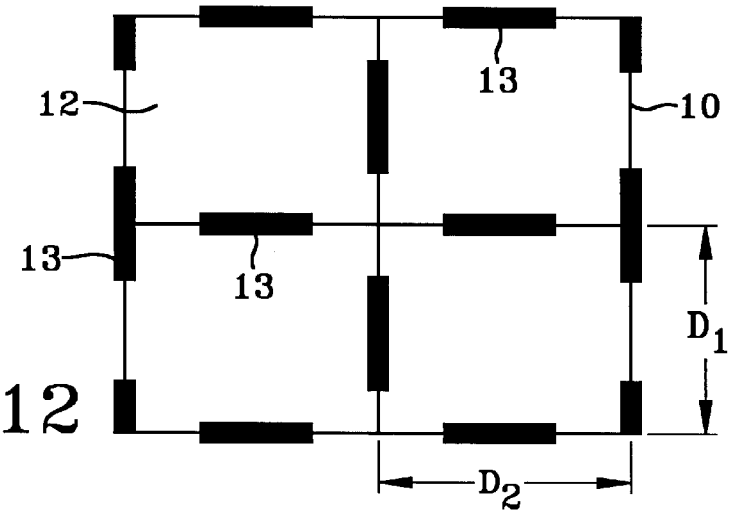
FIGS. 12–14 are schematic representations of various embodiments of the invention showing discontinuous three-dimensional features.
Figure 13:
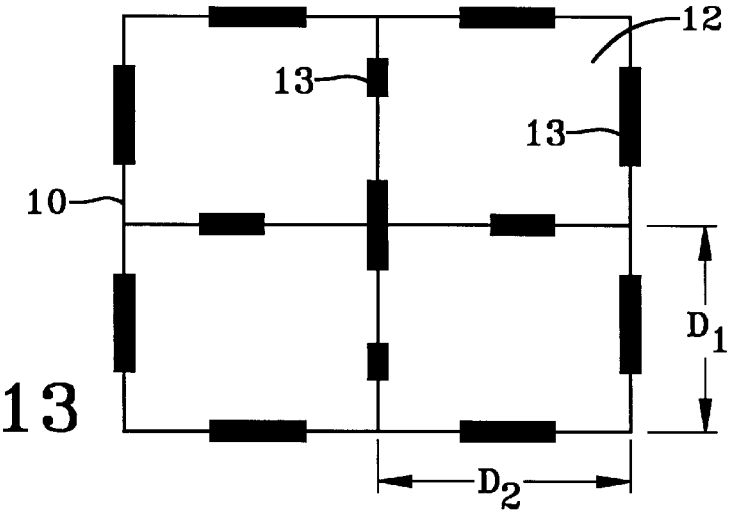
Figure 14:
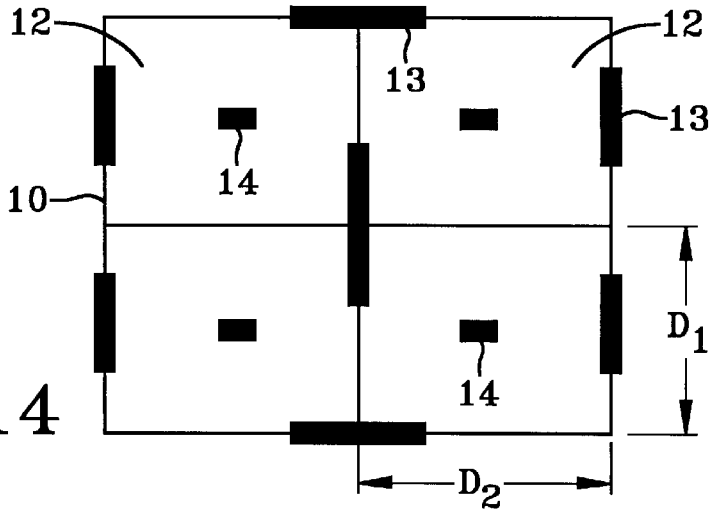

FIG. 9 is directed to the Interrupted Oxidation of the segmented samples, ribbed and grooved, and, as-sprayed and annealed (corrected for flat side delamination).

For as-sprayed samples, part of a flat side spalled off at 200 hr, and the remaining at 500 hr for a control sample. The flat backside of the ribbed sample delaminated at 150 hr, and the grooved sample at 200 hr.

For $H_2$ annealed samples, one flat side spalled off at 500 hr for a control sample. The flat backside of the ribbed sample spalled at 400 hr, and the grooved sample at 150 hr.

Table 1 compares the time until spallation of the control samples, the flat backsides of the ribbed or grooved samples both as-sprayed and $H_2$ annealed. As shown in Table 1, none of the segments on the ribbed samples spalled, both as-sprayed and $H_2$ annealed, after 2000 hr. Only the coating over some of the ribs spalled (about 1–2% of the surface area) after 2000 hr. The $H_2$ annealed grooved sample showed partial delaminations with 40% of the surface intact after 2000 hr. In general, the larger segments or edge segments were among the first to spall.

Table 2 is directed to the effect of segment size and position of the life of APS 8YSZ no-bond coat TBC on grooved samples. (The ribbed samples did not delaminate). The letters and numbers refer to position sites as shown in FIG. 7. For example, all A segment types are 0.05"×0.05" with a relative area of 1 unit, all B segment types are 0.05"×0.10" with a relative area twice that of A segment types. As can be readily ascertained, the segments with the larger areas and the edge segments were among the first to spall. For the as-sprayed sample, 38 of the 60 segments remained intact after 2000 hr. For the $H_2$ annealed sample, 42 of the 60 segments remained intact after 2000 hr.

In the examples given above, the grid size was varied to determine an optimum dimension for the TBC spallation life. For the grooved examples, failure times increased for smaller groove spacing while no failure occurred up to 2000 hr on the ribbed samples, for spacings up to 0.20 inches.

Similar to the previous tests, 1" diameter discs of low sulfur PWA1484 were machined on one side with a uniform grid of ribs. Sample #0 was a control sample with no ribs. Sample #R1 contained one inscribed square rib template, 0.71" to a side. Sample #R4 contained a grid network defining four equal segments, each being 0.35" to a side. Sample #R16 contained a grid network defining 16 equal segments, each 0.18" to a side, and sample #R64 contained a grid network of 64 equal segments, each 0.09" to a side. These samples were all plasma spray coated as before to a thermal barrier layer thickness of 0.010". They were oxidized as before at 1100° C. and weighed intermittently up to 2000 hr. Coating failures are summarized in Table 3. R1 failed by buckling in the center of the square rib template at 1000 hr. Sample R4 failed at 1400 hr. After 2000 hours, samples R16 and R64 did not fail.

In a further example, rectangular 0.050×0.5×0.75" coupons were machined on one side into ribbed networks with 1, 6, and 24 segments and plasma sprayed with 0.010" thick thermal barrier coating. These samples were tested in cyclic oxidation at 1100° C., with 1-hr cycles. Coating failures are summarized in Table 4. Flat control surfaces failed at 800–1000 hr (840 hr on average). With one rib segment of 0.5×0.75", sample S1, coating buckling occurred at 2000 hr. With 6 or 24 segments with 0.25" or 0.125" segments, samples S6 and S24, no coating buckling occurred up to 2000 hr.

Thus, the maximum segment spacing, D, for the ribbed samples appears to be in the range of 0.25" to 0.35", according to these tests.

The preferred embodiment of the invention utilizes a ribbed geometry rather than a grooved geometry because wider optimum spacings can be tolerated. Less frequent rib features are desirable from the standpoint of reduced weight and machining complexity. Ribs are also more desirable than grooves from the standpoint of longer TBC life and less opportunity for stress concentration and crack initiation in the alloy, as might be expected at the groove tips.

Each of the above-identified embodiments share the concept of a macro-segmented thermal barrier coating. For a square article 1"×1", macro-segmentation may require, for example, only ten rib or groove features along one direction as compared to 200 or more for the micro-grooving techniques known in the art. For this example, macro-segmentation according to the present invention results in only 100 segments, compared to 40,000 features for micro-grooving. Further, in the micro-grooving technique the grooves are approximately 0.0005" deep or 1/18 the thickness of a 0.009" thick coating. Bridging over the narrow, shallow grooves will occur by the deposition of the TBC. This bridging can diminish the effectiveness of any columnar discontinuity.

TABLE 1

Summary of Life for Flat or Segmented APS 8YSZ No-bondcoat TBC's on Low Sulfur, PWA 1484 In 1100° C. Interrupted Furnace Oxidation Tests

| Sample | Treatment | Life, hr | Avg. ± σ | Survived 2000 hr |
|---|---|---|---|---|
| Back Side, $A_1$ | As-sprayed | 200 | | N.A. |
| Back Side, $A_2$ | As-sprayed | 500 | | N.A. |
| Back Side, Ribbed | As-sprayed | 150 | | N.A. |
| Back Side, Grooved | As-sprayed | 200 | 262 ± 160 | N.A. |
| Back Side, $C_1$ | 1250° C., 50 hr. $H_2$ | 500 | | N.A. |
| Back Side, Ribbed | 1250° C., 50 hr. $H_2$ | 500 | | N.A. |
| Back Side, Grooved | 1250° C., 50 hr. $H_2$ | 150 | 383 ± 202 | N.A. |
| Beveled $edge_1$ | Chamfered coating | 700 | | N.A. |
| Beveled $edge_2$ | Chamfered coating | 1000 | 850 | N.A. |
| Grooved, as sprayed | As-sprayed | 500–2000 | >1717 ± 479 | 38 out of 60 |
| Grooved, $H_2$ | 1250° C., 50 hr. $H_2$ | 10–2000 | >1579 ± 736 | 42 out of 60 |
| Ribbed, as sprayed | As-sprayed | >2000 | >2000 | 60 out of 60 |
| Ribbed, $H_2$ | 1250° C., 50 hr. $H_2$ | >2000 | >2000 | 60 out of 60 |

TABLE 2

Effect of Segment Size and Position on the Life of an APS 8YSZ, No-bondcoat TBC on Grooved, Low Sulfur, PWA 1484 Discs in 2012° F. Interrupted Furnace Oxidation Tests

| ± (X, Y) position | Segment type | Relative area | Survival % | Avg. life (hr) | n, # | $\sigma_{(x, n-1)}$ |
|---|---|---|---|---|---|---|
| | | As-received Coating | | | | |
| 1,1 | A | 1.0 | 100 | >2000 | 4 | 0 |
| 2,1 | B | 2.0 | 100 | >2000 | 8 | 0 |
| 2,2 | C | 4.0 | 100 | >2000 | 4 | 0 |
| 3,1 | D | 4.0 | 88 | >1975 | 8 | 71 |
| 3,2 | E | 8.0 | 50 | >1800 | 8 | 267 |
| 3,3 | F | 16.0 | 0 | 1300 | 4 | 526 |
| 4,1 | G | 3.2 | 62 | >1575 | 8 | 682 |
| 4,2 | H | 5.3 | 62 | >1812 | 8 | 295 |
| 4,3 | I | 5.0 | 12 | 1012 | 8 | 532 |
| | | $H_2$ Annealed Coating at 1250° for 50 hr. | | | | |
| 1,1 | A | 1.0 | 100 | >2000 | 4 | 0 |
| 2,1 | B | 2.0 | 100 | >2000 | 8 | 0 |
| 2,2 | C | 4.0 | 100 | >2000 | 4 | 0 |
| 3,1 | D | 4.0 | 100 | >2000 | 8 | 0 |
| 3,2 | E | 8.0 | 62 | >1763 | 8 | 350 |
| 3,3 | F | 16.0 | 0 | 1025 | 4 | 780 |
| 4,1 | G | 3.2 | 75 | >1500 | 8 | 926 |
| 4,2 | H | 5.3 | 62 | >1626 | 8 | 695 |
| 4,3 | I | 5.0 | 0 | 408 | 8 | 659 |

TABLE 3

TBC Failure Times for Uniform Rib Segments on Low Sulfur, PWA 1484 Discs in 1100° C. Intermittent Oxidation Tests

| Sample # | R0 | R1 | R4 | R16 | R64 |
|---|---|---|---|---|---|
| grid size, D, in. | none | 0.71 | 0.35 | 0.18 | 0.09 |
| flat side delamination, hr | 700, 1000 | 600 | 400 | 600 | 700 |
| ribbed side buckling, hr | N.A. | 1000 | 1400 | >2000 | >2000 |

TABLE 4

TBC Failure Times for Uniformly Ribbed Low Sulfur, PWA 1484 Coupons in 1100° C. Cyclic Oxidation Tests

| Sample # | S0 | S1 | S6 | S24 |
|---|---|---|---|---|
| grid size, D, in. | none | 0.5 × 0.75 | 0.25 | 0.125 |
| flat side delamination, hr | 800, 1000 | 800 | 800 | 800 |
| ribbed side buckling, hr | N.A. | 2000 | >2000 | >2000 |

With any of the aforementioned embodiments, linear arrays of equally spaced ribs 20 or grooves 40 may be the most conveniently manufactured. However, the present invention does not require exact geometric regularity in spacing or design.

The invention has been described with reference to preferred embodiment. Obviously, modifications and alterations will occur to others upon a reading and understanding of this specification. It is intended to include all such modifications and alternations in so far as they come within the scope of the appended claims or the equivalence thereof.

Having thus described the invention, it is now claimed:

1. An article protected by a thermal barrier coating system comprising:

a substrate having a first surface for supporting a thermal barrier coating;

a thermal barrier coating including a thermal barrier layer being associated with a thickness T; and, means for segmenting said thermal barrier coating, said segmenting means including a plurality of three-dimensional features being positioned along an imaginary grid defined by a predetermined relationship to said first surface of said substrate, said imaginary grid defining cells of dimension $D_1 \times D_2$ wherein $D_1$ has a value in the range of 0.05 inches to 0.30 inches, inclusive and $D_2$ has a value in the range of 0.05 inches to 0.30 inches, inclusive.

2. The article of claim 1 wherein $D_1$ is not equal to $D_2$.

3. The article of claim 1 wherein $D_1$ is substantially equal to $D_2$.

4. The article of claim 1 wherein said imaginary grid is coincident with said first surface of said substrate and said features are raised ribs formed on said first surface, and wherein said ribs have an associated rib height, R.

5. The article of claim 4 wherein said ribs are continuous.

6. The article of claim 4 wherein said ribs are discontinuous.

7. The article of claim 4 wherein R has a value approximately 25% to 100% of T.

8. The article of claim 1 wherein said imaginary grid is coincident with said first surface of said substrate means and said features are grooves formed in said first surface, and wherein said grooves have an associated groove depth, G.

9. The article of claim 8 wherein G has a value approximately 25% to 100% of T.

10. The article of claim 1 wherein said thermal barrier coating further includes a bond coat layer intermediate said substrate means and said thermal barrier layer and wherein said imaginary grid is coincident with a first surface of said bond coat layer and said features are raised ribs formed on said first surface of said bond coat layer, and wherein said ribs have an associated rib height R.

11. The article of claim 10 wherein R has a value approximately 25% to 100% of T.

12. The article of claim 1 wherein said thermal barrier coating further includes a bond coat layer intermediate said substrate and said thermal barrier layer and wherein said imaginary grid is coincident with a first surface of said bond coat layer and said features are grooves formed in said first surface of said bond coat layer, and wherein said grooves have a groove depth G.

13. The article of claim 12 wherein G has a value approximately 25% to 100% of T.

14. The article of claim 1 wherein T has a value from approximately 0.002 inches (0.005 cm) to 0.03 inches (0.075 cm), inclusive.

15. The article of claim 1 wherein said features are associated with a width W, and wherein $D_1$ has a value at least 10W.

16. The article of claim 1 further comprising:

a three-dimensional feature being positioned within a cell of said imaginary grid.

17. A method for preparing a coated article having a segmented thermal barrier coating comprising the steps of:

furnishing a substrate having a first surface;

imposing an imaginary grid defining cells of dimension $D_1 \times D_2$ in a predetermined relationship to said first surface, wherein $D_1$ has a value in the range of 0.05 inches to 0.30 inches, inclusive, and $D_2$ has a value in the range of 0.05 inches to 0.30 inches, inclusive;

providing a plurality of three-dimensional features positioned along said imaginary grid; and, applying said thermal barrier coating including a thermal barrier layer to said substrate.

18. The method of claim 17 wherein said step of providing a plurality of three-dimensional features includes providing raised ribs on said first surface of said substrate, wherein said ribs have a associated rib height R.

19. The method of claim 17 wherein said step of providing a plurality of three-dimensional features includes providing grooves in said first surface of said substrate, wherein said grooves have a associated groove depth G.

20. The method of claim 17 wherein said step of applying said thermal barrier coating includes applying a bond coat layer intermediate said substrate and said thermal barrier layer.

21. The method of claim 20 wherein said step of providing a plurality of three-dimensional features includes providing raised ribs on a first surface of said bond coat layer, wherein said ribs have an associated rib height R.

22. The method of claim 20 wherein said step of providing a plurality of three-dimensional features includes providing grooves in a first surface of said bond coat layer, wherein said grooves have an associated groove depth G.

23. The method of claim 17 wherein said step of applying said thermal barrier coating to said substrate includes applying said thermal barrier layer directly to said substrate.

* * * * *